US007651095B1

(12) United States Patent
Pillalamarri et al.

(10) Patent No.: US 7,651,095 B1
(45) Date of Patent: Jan. 26, 2010

(54) MULTIPLAYER TRIVIA GAME

(75) Inventors: Satish Pillalamarri, Silver Spring, MD (US); Dominic Crapuchettes, Bethesda, MD (US)

(73) Assignee: North Start Games, LLC, Bethesda, MA (US)

( * ) Notice: Subject to any disclaimer, the term of this patent is extended or adjusted under 35 U.S.C. 154(b) by 0 days.

(21) Appl. No.: 11/203,283

(22) Filed: Aug. 15, 2005

Related U.S. Application Data

(60) Provisional application No. 60/601,005, filed on Aug. 13, 2004.

(51) Int. Cl.
*A63F 1/00* (2006.01)

(52) U.S. Cl. ..... 273/274; 273/429

(58) Field of Classification Search ..... 273/274, 273/429, 430, 431, 432
See application file for complete search history.

(56) References Cited

U.S. PATENT DOCUMENTS

| | | | | |
|---|---|---|---|---|
| 4,326,711 | A | 4/1982 | Giallombardo | |
| 4,666,161 | A * | 5/1987 | Elesie et al. | 273/246 |
| 5,746,431 | A * | 5/1998 | McIntyre et al. | 273/247 |
| 6,070,874 | A * | 6/2000 | Ivers | 273/292 |
| 6,267,376 | B1 | 7/2001 | Jenkins | |
| 6,331,144 | B1 | 12/2001 | Walker | |
| 6,394,899 | B1 * | 5/2002 | Walker | 463/9 |
| 6,471,207 | B1 | 10/2002 | Schlaifer | |
| 6,863,606 | B1 | 3/2005 | Berg | |
| 2001/0015527 | A1 | 8/2001 | George | |
| 2001/0038178 | A1 | 11/2001 | Vancura | |
| 2002/0043759 | A1 | 4/2002 | Vancura | |
| 2002/0140170 | A1 | 10/2002 | Vazzana | |
| 2003/0071416 | A1 | 4/2003 | Vancura | |

* cited by examiner

*Primary Examiner*—William M Pierce
(74) *Attorney, Agent, or Firm*—McNeely & Hare LLP; Kevin J. McNeely

(57) ABSTRACT

A trivia game includes more than one answer choice to each question. The players generate each answer choice.

20 Claims, 5 Drawing Sheets

MULTIPLAYER TRIVIA GAME

CROSS REFERENCE TO RELATED APPLICATION

This nonprovisional utility patent application claims priority to U.S. provisional patent Ser. No. 60/601,005 filed on Aug. 13, 2004, which is incorporated herein by reference.

FIELD OF THE INVENTION

The present invention relates to games and, more specifically, to multiplayer trivia games.

BACKGROUND

A trivia game is a question and answer game that requires players to use their knowledge when providing the answer to a factual question. Typically, such games are won by players who have some specific knowledge or skill relating to certain topics, such as, for example, memorization of historical facts or trivia. Players who lack substantial trivia knowledge relating to a topic are at a disadvantage and may not be motivated to participate. Thus, a need exists for a multiplayer question and answer game that allows players with limited background knowledge on certain trivia topics to win or be competitive at the game.

SUMMARY

In one general aspect, a method of playing a trivia game includes prompting two or more players to each generate an answer choice to each question.

Embodiments may include one or more of the following features. For example, the method may include selecting an answer choice generated by one of the players as the winning answer. The winning answer may be the answer choice generated by one of the players that has the closest numerical value to a correct answer or the answer choice generated by one of the players that has the closest numerical value to a correct answer without exceeding the numerical value of the correct answer.

The method may also include instructing players to choose one or more answer choice generated by one of the players as the winning answer and/or allowing players to put a wager on one or more answer choice as the winning answer. Players selecting a winning answer may be awarded in an amount equal to the product of the wager and a payout multiple. Players selecting a losing answer may be penalized in an amount of the wager.

Each answer choice generated by the players may be assigned a payout multiple. The assigned payout multiple may be higher for more risky answer choices and lower for less risky answer choices.

In another general aspect, a trivia game includes a playing surface having more than one answer position, each answer position configured to receive an answer choice generated by one of the players.

Embodiments may include one or more of the above or following features. For example, each answer position may have a payout multiple such that an answer choice occupying the answer position includes the payout multiple.

In another embodiment, there is a series of answer positions configured to receive at least one answer choice according to a numerical order from the smallest answer choice to the largest answer choice. The series may include a first, second, third, fourth, fifth, sixth, and seventh answer positions arranged to receive each answer choice according to a numerical value from a smallest answer choice to a largest answer choice. In this implementation, the first and seventh answer positions may have a payout multiple of 4 to 1, the second answer and sixth answer positions may have a payout multiple of 3 to 1, the third and fifth answer positions may have a payout multiple of 2 to 1, and the fourth answer position may have a payout multiple of 1 to 1.

Other features may include more than one player card configured to receive an answer choice or a player identification. Alternatively, each player card may include a player identification, such as, for example, a color or symbol. Poker chips may also be used to keep track of player wagers and scores.

In a further general aspect, a trivia game implemented by a computer software program may include a first code segment to prompt two or more players to each generate an answer choice to each question, a second code segment to assign a payout multiple to each answer choice such that a more risky answer choice includes a higher payout multiple and a less risky answer choice includes a lower payout multiple, a third code segment to allow players to put a wager on one or more answer choice, a fourth code segment to determine a winning answer as the answer choice having a closest numerical value to a correct answer, a fifth code segment to award players that select the winning answer, and a sixth code segment to penalize players that put a wager on a losing answer. The software program may include one or more of the features described above.

DETAILED DESCRIPTION

In a board game utilizing the present invention all players participate in generating responses to each question. Players don't need to know the exact answer to win. Every player responds to each question and players may wager on any guess that they think is closest to being correct. Players use their knowledge of trivia, the interests of their friends, and/or the odds to help decide how to wager. The closest answer then pays out according to the odds on the playing surface.

Figure 1:
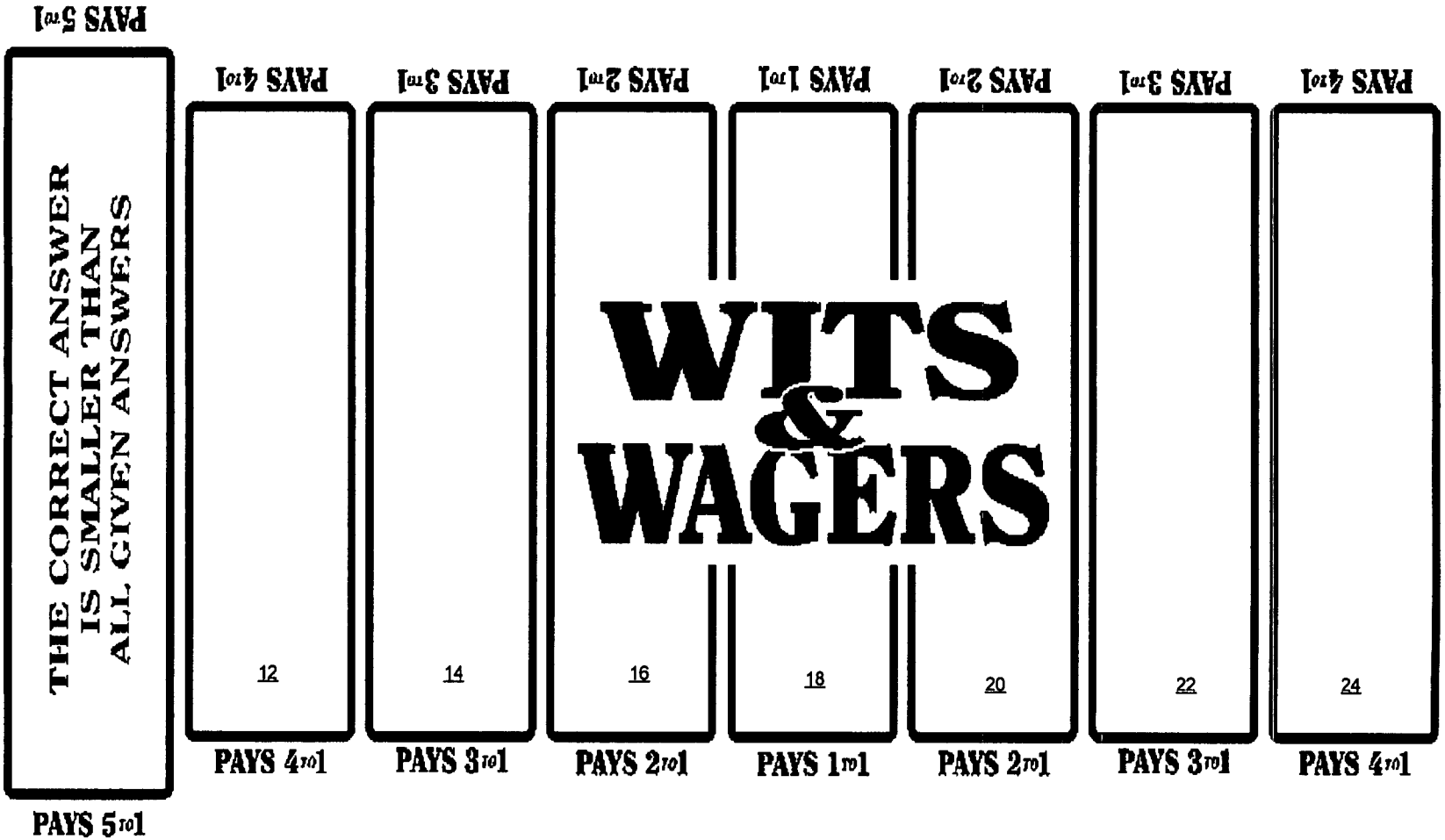
FIGS. 1 and 2 illustrate a playing surface for the game.
Figure 2:
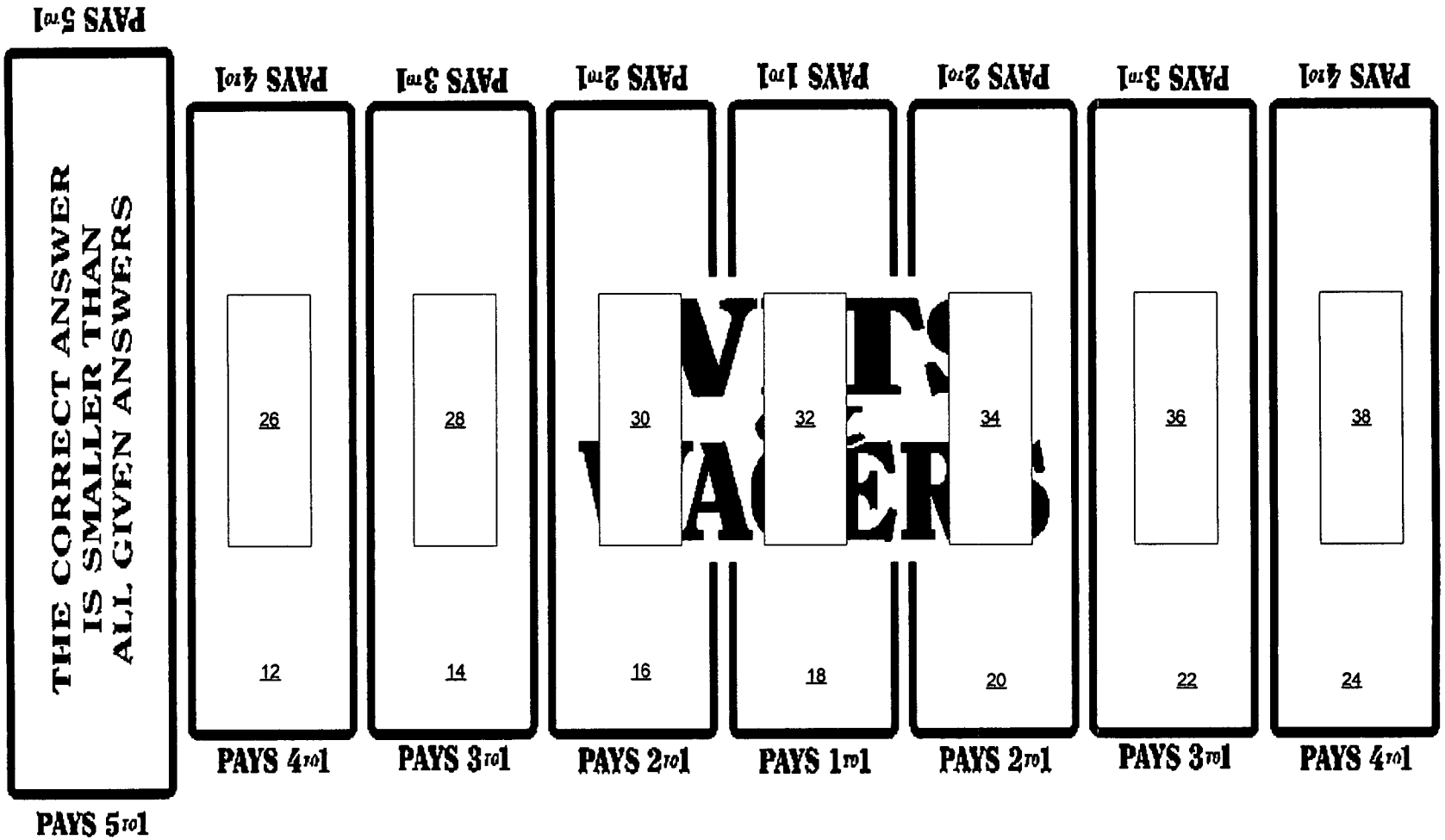

Referring to FIGS. 1 and 2, the playing surface 10 includes first, second, third, fourth, fifth, sixth, and seventh answer positions 12, 14, 16, 18, 20, 22, 24 arranged in a row that have varying assigned odds. Answer positions one 12 and seven 24 have a payout multiple of 4 to 1; answer positions two 14 and six 22 have a payout multiple of 3 to 1; answer positions three 16 and five 20 have a payout multiple of 2 to 1; and answer position four 18 has a payout multiple of 1 to 1.

Answer cards 26, 28, 30, 32, 34, 36, 38 with a dry erasable writing surface can be positioned on the answer positions 12-24. The players write their answers on the answer cards 26-38. All of the answers are numerical, allowing them to be arranged from smallest answer to largest answer from left to right. Players also receive chips (not shown) which are also positioned on the answer positions 12-24 to wager on the potential winning answer.

Figure 3:
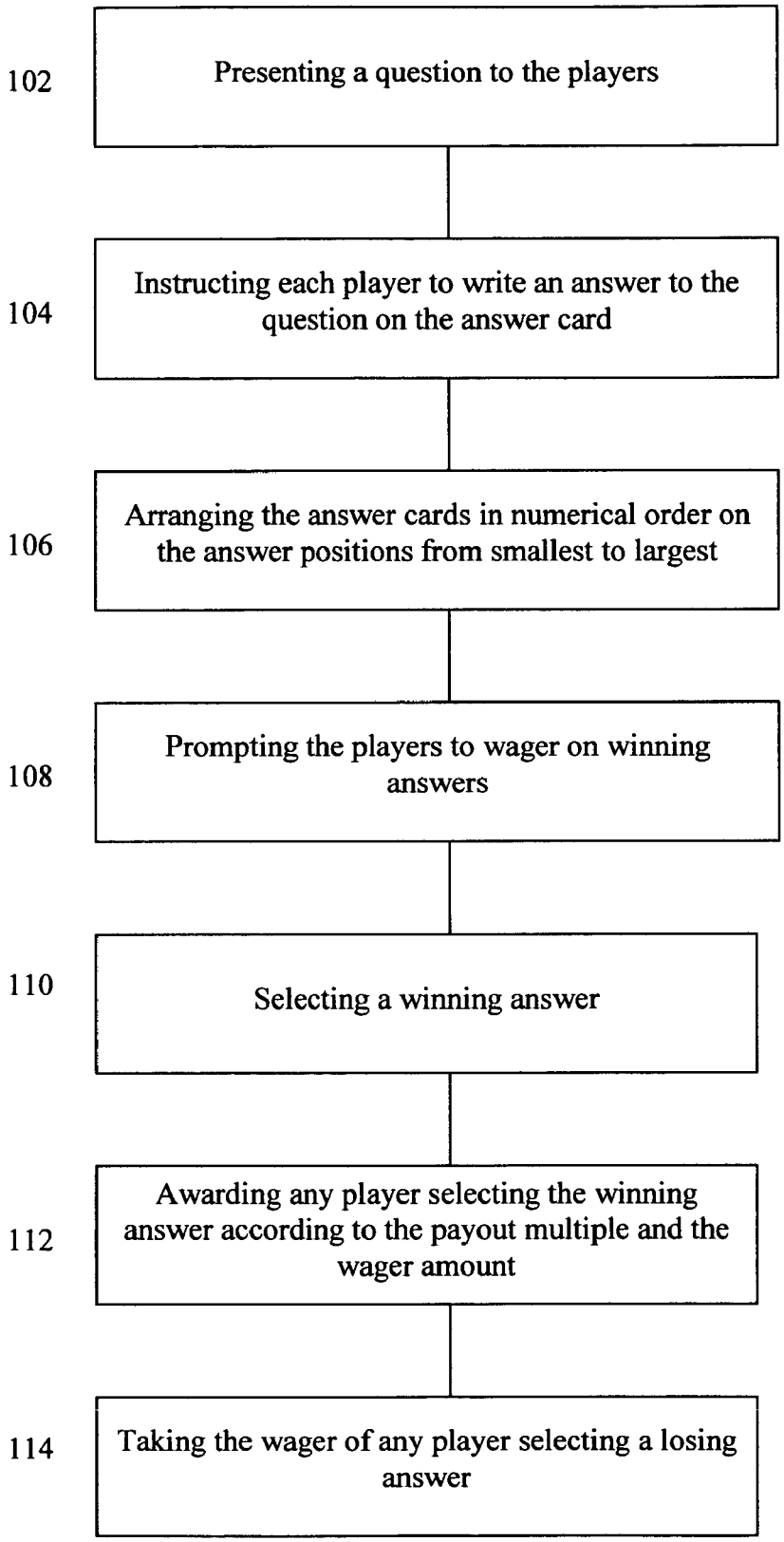
FIG. 3 shows a method of play.

Referring to FIG. 3 a method of play begins by reading a question to the players (step 102). Each player is instructed to write an answer on their playing card (step 104) and then places their playing card on the playing surface.

The answers are arranged from smallest answer to largest answer from left to right on the playing surface answer positions (step 106). The position on the playing surface determines the payout multiple for each answer. Since the median answer is generally most likely to be the winning answer in any group of answers to a random question, the answer occupying the center or fourth answer position 18 has the lowest payout multiple. Similarly, since the "outlying" answers are least likely to be the winning answer, the answers occupying the first and seventh answer positions 12, 24 have the highest payout multiple.

The players are prompted to wager on what they think is the winning answer (step 108). In one embodiment, the players are allowed to wager on one answer choice. In another embodiment, the players are allowed to wager on one or more answer choices. Each player places chips representing a point value on the anticipated winning answer. In placing a wager on an answer choice, the players are allowed to wager on any player answer as the winning answer and do not necessarily have to select the answer that they generated as the winning answer.

The correct answer is revealed and compared to the player answers. In one embodiment, the winning answer is selected as the closest player answer. In another embodiment, the winning answer is the closest player answer that does not exceed the value of the correct answer (step 110).

Players who wagered on the winning answer are awarded in an amount equal to the product of the point value of the wager and the payout multiple (step 112). Players that wagered on a losing answer lose any chips placed on the losing answer (step 114).

The multiplayer game can be implemented by software, such as, for example, by storing a game program on a CD-ROM or on a storage device of a personal computer with a computer display screen or with players at remote terminals over the Internet. Other implementations include television game shows, electronic bartop games, cellular phone games, video games and slot machine games.

Figure 4:
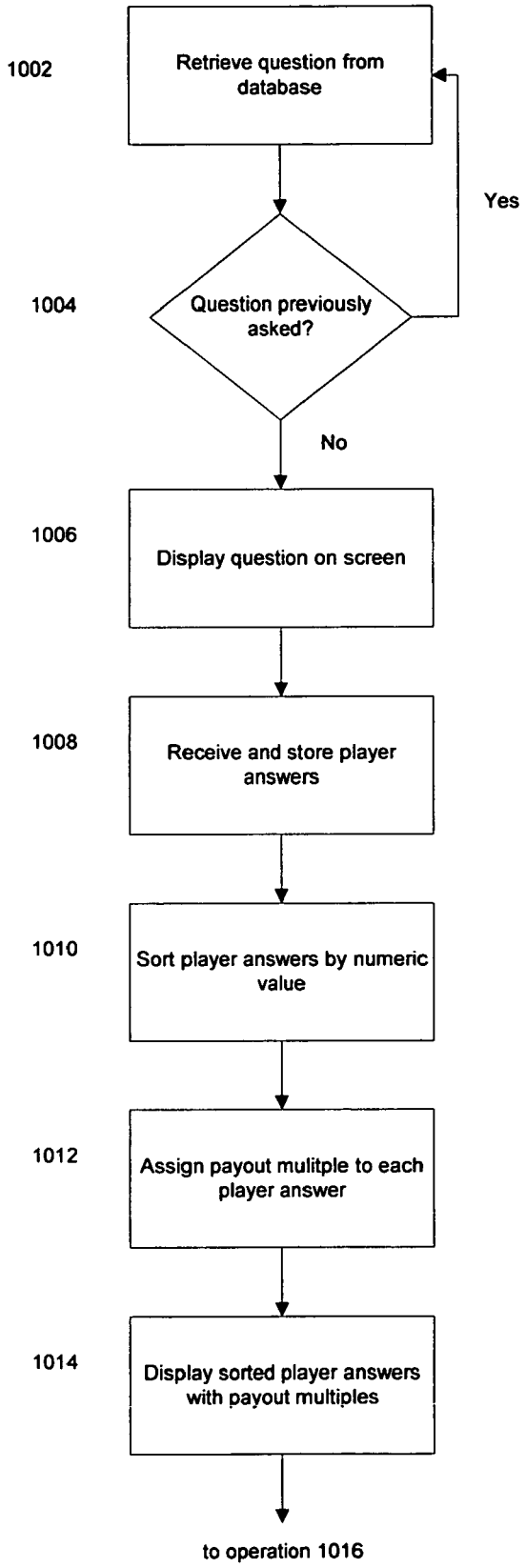
FIGS. 4 and 5 show a game implemented by a software program.
Figure 5:
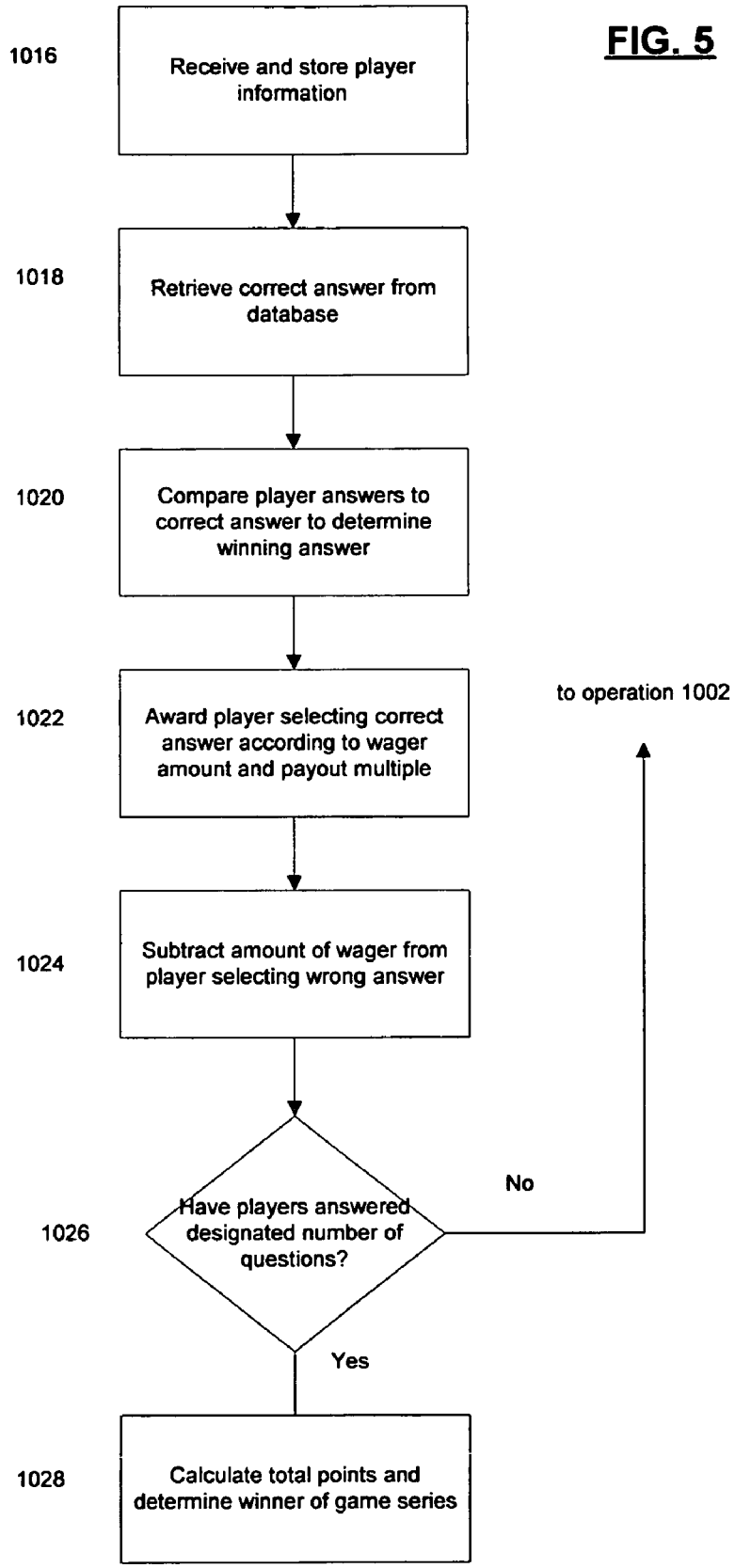

Referring to FIGS. 4 and 5, the software program retrieves a question from a database of questions (operation 1002). If the question has already been asked, another question is retrieved (operation 1004).

The question is displayed on one or more display terminals used by the players (1006). Each player inputs a response to the question using an input device, such as, for example, a keyboard, and the responses are stored (operation 1008). The player responses are sorted or rank ordered according to numerical value (operation 1010).

Each response is assigned a payout multiple according to its numerical position relative to other responses (operation 1012). The median answer is assigned a payout multiple of 1 to 1. Responses above or below the median are assigned higher payout multiples, such as, for example, 2 to 1, 3 to 1, or 4 to 1.

The program displays the sorted player responses with corresponding payout multiples on the display screen (operation 1014). The players can then input their bets or wager on any of the player responses as the winning answer. The program stores the player wager information (operation 1016).

The correct answer is retrieved from the database (operation 1018) and is compared to the player responses to determine the winning answer (operation 1020). In one embodiment, the operation to select the winning answer may include subtracting the player response from the correct answer and designating the lowest numeric value greater than or equal to zero as the winning answer. In another embodiment, the operation to select the winning answer may include subtracting the player response from the correct answer and designating the lowest absolute value as the winning answer.

Players selecting the winning answer receive an award amount by calculation of the product of the wager amount and the payout multiple (operation 1022). The award amount is added to the player's total points for a new point total. Players selecting a losing answer have their wager amount subtracted from their point totals (operation 1024).

Play continues for a series of questions (operation 1026). Once the series of questions is completed, the game ends by determining the winner as the player with the highest total amount of points (operation 1028).

The game may be implemented by hardware, software, or a combination thereof. Changes may be made in the above apparatus and process without departing from the scope of the invention. Thus, all matter contained in the description or shown in the drawings shall be interpreted in an illustrative and not in a limiting sense. Accordingly, other implementations are within the scope of the following claims.

We claim:

1. A method of playing a trivia game, comprising:

providing one or more player at least one question;

prompting each player to generate an answer choice to each player's respective at least one question;

positioning each answer choice in a numerical order;

assigning a payout multiple to each answer choice based on the numerical order;

prompting each player to select one or more potential winning answer from a set of answer choices;

determining a winning answer; and a awarding an amount according to the payout multiple of the winning answer to any player that selects the winning answer as the player's selected potential one or more potential winning answer.

2. The method of claim 1, further comprising:

including each generated player answer choice in the set of answer choices.

3. The method of claim 1, wherein:

the set of answer choices consists of each generated player answer choice.

4. The method of claim 1, wherein:

prompting each player to select one or more potential winning answer comprises prompting each player to select one or more potential winning answer from the set of answer choices that includes each player answer choice.

5. The method of claim 1, wherein:

determining the winning answer includes selecting an answer choice that has the closest numerical value to a correct answer.

6. The method of claim 1, wherein:

determining the winning answer includes selecting an answer choice that has the closest numerical value to a correct answer without exceeding the numerical value of the correct answer.

7. The method of claim 1, further comprising:

prompting players to choose one or more answer choice generated by one of the players as the potential winning answer.

8. The method of claim 1, further comprising:

allowing each player to put a wager on one or more answer choice as the player's selected potential winning answer.

9. The method of claim 8, further comprising:

awarding any player that put a wager on the winning answer an amount equal to the product of the player's wager and the assigned payout multiple.

10. The method of claim 8, further comprising:

penalizing any player that put a wager on a losing answer an amount equal to the player's respective wager.

11. The method of claim 1, wherein assigning the payout multiple to each answer choice includes assigning an answer choice with a greater risk of not being determined as the winning answer includes a higher payout multiple and an answer choice with a lesser risk of not being determined as the winning answer includes a lower payout multiple.

12. A trivia game, comprising:

means for prompting a player to answer a question;

one or more player record to receive each player answer; and a playing surface having more than one answer position, each answer position configured to receive a player answer in a numerical order, wherein each answer position includes a payout multiple such that a player answer occupying the answer position includes the payout multiple.

13. The game of claim 12, wherein:

the more than one answer position comprises a series of answer positions configured to receive at least one player answer according to a numerical order from a smallest player answer to a largest player answer.

14. The game of claim 12, wherein:

the more than one answer position comprises a first answer position, a second answer position, a third answer position, a fourth answer position, a fifth answer position, a sixth answer position, and a seventh answer position arranged to receive player answers according to a numerical value from a smallest player answer to a largest answer choice.

15. The game of claim 14, wherein:

the first answer position and seventh answer position have a payout multiple of 4 to 1;

the second answer position and the sixth answer position have a payout multiple of 3 to 1;

the third answer position and the fifth answer position have a payout multiple of 2 to 1; and the fourth answer position has a payout multiple of 1 to 1.

16. The game of claim 12, each player record comprises:

a player card configured to receive an answer choice.

17. The game of claim 12, further comprising:

more than one player card configured to receive a player identification.

18. The game of claim 12, further comprising:

more than one player card that includes a player identification.

19. The game of claim 12, further comprising:

poker chips to keep track of player wagers and scores.

20. A computer readable medium having embodied thereon a computer program for processing by a computer, the computer program comprising:

a first code segment to provide at least one question to one or more player;

a second code segment to prompt each player to generate a player answer choice to each of the player's respective one or more question;

a third code segment to position each player answer choice in a numerical order;

a fourth code segment to assign a payout multiple to each player answer choice based on the numerical order;

a fifth code segment to prompt each player to select one or more potential winning answer from a set of answers that includes each player answer choice;

a sixth code segment to determine a winning answer from the one or more potential winning answer; and a seventh code segment to award an amount according to the payout multiple of the winning answer to any player that selects the winning answer as the player's selected potential one or more potential winning answer.

* * * * *